US007749294B2

(12) United States Patent
Oh et al.

(10) Patent No.: US 7,749,294 B2
(45) Date of Patent: Jul. 6, 2010

(54) COMPACT ROBOT VACUUM CLEANER

(75) Inventors: Jang-keun Oh, Gwangju (KR); Hak-bong Lee, Jeollanam-do (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 1051 days.

(21) Appl. No.: 11/455,646

(22) Filed: Jun. 20, 2006

(65) Prior Publication Data

US 2007/0137153 A1 Jun. 21, 2007

(30) Foreign Application Priority Data

Dec. 19, 2005 (JP) ..... 10-2005-125664

(51) Int. Cl.
*B01D 45/00* (2006.01)
*A47L 9/10* (2006.01)
*A47L 5/00* (2006.01)

(52) U.S. Cl. ..... 55/356; 55/357; 55/385.1; 55/429; 55/467; 55/459.1; 15/319; 15/353; 15/DIG. 3

(58) Field of Classification Search ..... 55/356, 55/DIG. 3, 428–429, 459.1, 357, 385.1, 467; 15/353, 319
See application file for complete search history.

(56) References Cited

U.S. PATENT DOCUMENTS

| | | | | |
|---|---|---|---|---|
| 4,593,429 | A * | 6/1986 | Dyson | 15/353 |
| 5,092,476 | A * | 3/1992 | Yasuda et al. | 215/398 |
| 6,168,641 | B1 * | 1/2001 | Tuvin et al. | 55/337 |
| 6,810,558 | B2 | 11/2004 | Lee | |
| 6,977,003 | B2 * | 12/2005 | Lim et al. | 55/337 |
| 7,113,847 | B2 * | 9/2006 | Chmura et al. | 700/245 |
| 7,207,083 | B2 * | 4/2007 | Hayashi et al. | 15/347 |
| 7,276,099 | B2 * | 10/2007 | Hayashi et al. | 55/429 |
| 7,540,335 | B2 * | 6/2009 | Andriolo et al. | 173/18 |
| 2005/0198769 | A1 | 9/2005 | Lee et al. | |
| 2006/0185113 | A1 * | 8/2006 | Kloeppel et al. | 15/320 |

FOREIGN PATENT DOCUMENTS

| | | | |
|---|---|---|---|
| CN | 1425352 | | 6/2003 |
| EP | 0885585 | | 12/1998 |
| EP | 1 360 922 | A3 | 6/2005 |
| GB | 2 344 778 | A | 6/2000 |
| GB | 2344778 | A * | 6/2000 |
| JP | 2003-236410 | | 8/2003 |
| JP | 2005-27862 | | 2/2005 |
| JP | 2005-177100 | | 7/2005 |
| KR | 20-0333880 | | 11/2003 |
| RU | 2253346 | | 6/2005 |

* cited by examiner

*Primary Examiner*—Duane Smith
*Assistant Examiner*—Ives Wu
(74) *Attorney, Agent, or Firm*—Blank Rome LLP

(57) ABSTRACT

A robot cleaner that has a dust collection unit with a cyclone part generating an ascending rotary air current from the dust-laden air being drawn in through a lower part thereof, separating the dust from the air using a centrifugal force, and discharging the dust-separated air to the lower part through a center part, and a collection part surrounding the cyclone part to receive the dust being centrifugally separated.

6 Claims, 7 Drawing Sheets

COMPACT ROBOT VACUUM CLEANER

CROSS-REFERENCE TO RELATED APPLICATIONS

This application may relate to co-pending, commonly owned U.S. patent application Ser. Nos. 10/753,322, filed Jan. 9, 2004, and 10/887,840, filed Jul. 12, 2004, the subject matter of each of which is incorporated herein by reference.

REFERENCE TO RELATED APPLICATION

This application claims benefit under 35 U.S.C. §119(a) of Korean Patent Application No. 2005-125664, filed Dec. 19, 2005, the entire contents of which are incorporated herein by reference.

FIELD OF THE INVENTION

The present invention relates to a vacuum cleaner. More particularly, the present invention relates to a robot vacuum cleaner that adopts a cyclone structure.

BACKGROUND OF THE INVENTION

Conventional robot cleaners generally comprise a dust suction unit, which includes a suction port and a rotary brush, a suction motor which provides a vacuum source, a sensor unit which includes an obstacle sensor and a distance sensor measuring a traveling distance and location, driving rollers mounted on both sides thereof, a driving motor for driving the driving rollers, a diverting roller mounted on front and rear sides thereof, and a control unit which controls the dust suction unit, the sensor unit and the driving unit.

The dust suction unit of a conventional robot cleaner usually uses a dust bag made of paper or fabric to collect dust therein. The dust bag also serves as a filter. When using a dust bag made of plastic, a predetermined filter is often separately installed to filter air and discharge the filtered air toward the suction motor. However, when the dust bag is full or the dust receptacle is blocked, the suction force drops considerably, accordingly deteriorating cleaning performance.

Also, conventional robot cleaners generally use a rechargeable battery, which supplies limited amounts of electric power, and accordingly uses a small-size suction motor consuming relatively less power to maintain compact size of the robot cleaner. However, such a small-size suction motor has lower suction efficiency than general suction motors.

In order to overcome the limited suction efficiency of the small-size suction motor, a cyclone structure has been widely used, which is superior to the dust bag with regards to the suction efficiency and even recyclable. Exemplary robot cleaners adopting such a cyclone structure are disclosed in British Patent No. 2344778 and Korean Patent No. 333880, the subject matter of each of which is incorporated by reference.

In British Patent No. 2344778, cyclone units having a conical shape are laterally mounted. However, since this structure increases the volume of the cyclone unit, the robot cleaner is bulky and not compact. In the robot cleaner disclosed in Korean Patent No. 333880, a cyclone unit having a cylindrical form is vertically mounted into a cleaner body and is fluidly communicated through a separate suction pipe connected to a suction port. This structure also makes it hard to compactly design the robot cleaner because the dust receptacle connected to a lower part of the cyclone unit increases the height of dust collection unit.

Furthermore, the cyclone structures as disclosed in British Patent No. 2344778 and Korean Patent No. 333880 have a longer dust suction path for generating a rotating air current than the dust bag structure. The long dust suction path causes loss of energy due to friction with the rotating air current, thereby seriously deteriorating the initial suction force.

If a medium-size motor having higher suction efficiency is used, more rechargeable batteries are required to supply more electric power for driving the medium-size motor. However, this increases weight of the robot cleaner. Additionally, when adopting the cyclone structure in a robot cleaner, centroid of the robot cleaner inclines to the upper side as the height of the robot cleaner is increased. If the robot cleaner climbs an obstacle, such as a doorsill, the robot cleaner may fall down and be damaged.

SUMMARY OF THE INVENTION

An aspect of the present invention is to solve at least the above problems and/or disadvantages and to provide at least the advantages described below. Accordingly, an aspect of the present invention is to provide a robot cleaner having compact size.

Another aspect of the present invention is to provide a robot cleaner with a high suction force although adopting a cyclone structure.

In order to achieve the above-described aspects of the present invention, there is provided a robot cleaner that has a dust collection unit including a cyclone part generating an ascending rotary air current from the dust-laden air being drawn in through a lower part thereof, separating the dust from the air using a centrifugal force, and discharging the dust-separated air to the lower part through a center part; and a collection part surrounding the cyclone part to receive the dust being centrifugally separated. According to this structure, the height of the robot cleaner can be reduced, thereby providing a compact robot cleaner.

The dust collection unit may overlap, at a lower part thereof, with a discharge path for guiding the air dust-separated by the dust collection unit to a discharge port.

The cyclone part may include an inner canister for discharging therethrough the dust-separated air to a discharge path; an outer canister enclosing the inner canister and forming a boundary between the cyclone part and the collection part; and a bottom wall disposed at the inner and the outer canisters to form a spiral path, wherein the bottom wall isolates one side of a suction path and the discharge path from the spiral path, respectively.

Accordingly, since the rotative force is exerted through the spiral path to the air being drawn in through the suction path, a high average suction force as well as a high initial suction force can be guaranteed. Also, the size of the robot cleaner can be slimed by adopting the cyclone part having the low height.

The dust collection unit may further comprise a cover removably connected to an upper part thereof to open and close the cyclone part and the collection part. The cover may comprise a concave portion disposed on the cover at a position corresponding to the inner canister of the cyclone part and recessed toward the inner canister, to decrease volume of an upper end portion of the inner canister for favorable discharge of the air dust-separated by the cyclone part; and one or more handles mounted in the concave to help withdrawal of the dust collection unit from the cleaner body. The one or more handles may be pivotably mounted by one ends thereof by a fixing projection formed in the concave.

The robot cleaner may further comprise a locking unit for connecting the cover lockably to the dust collection unit. The locking unit may comprise a pivot shaft pivotably connected to one lower side of the cover; a lever connected to one side of the pivot shaft to rotate the pivot shaft; one or more driving hooks connected by one ends thereof to a circumference of the pivot shaft and pivoting by an angle the same as a rotating angle of the pivot shaft; one or more fixing hooks dispose at one side of the dust collection unit and snap-connected with the one or more driving hooks; and a return spring exerting resilience to the pivot shaft so as to resiliently bias the one or more driving hooks toward the corresponding fixing hooks.

According to another aspect of the present invention, there is provided a vacuum cleaner that has dust collection unit with a cyclone part generating an ascending rotary air current from the dust-laden air being drawn in through a lower part thereof, separating the dust from the air using a centrifugal force, and discharging the dust-separated air to the lower part through a center part; and a collection part surrounding the cyclone part to receive the dust being centrifugally separated, and the dust collection unit overlapping at a lower part thereof with a discharge path for guiding the air dust-separated by the dust collection unit to a discharge port.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
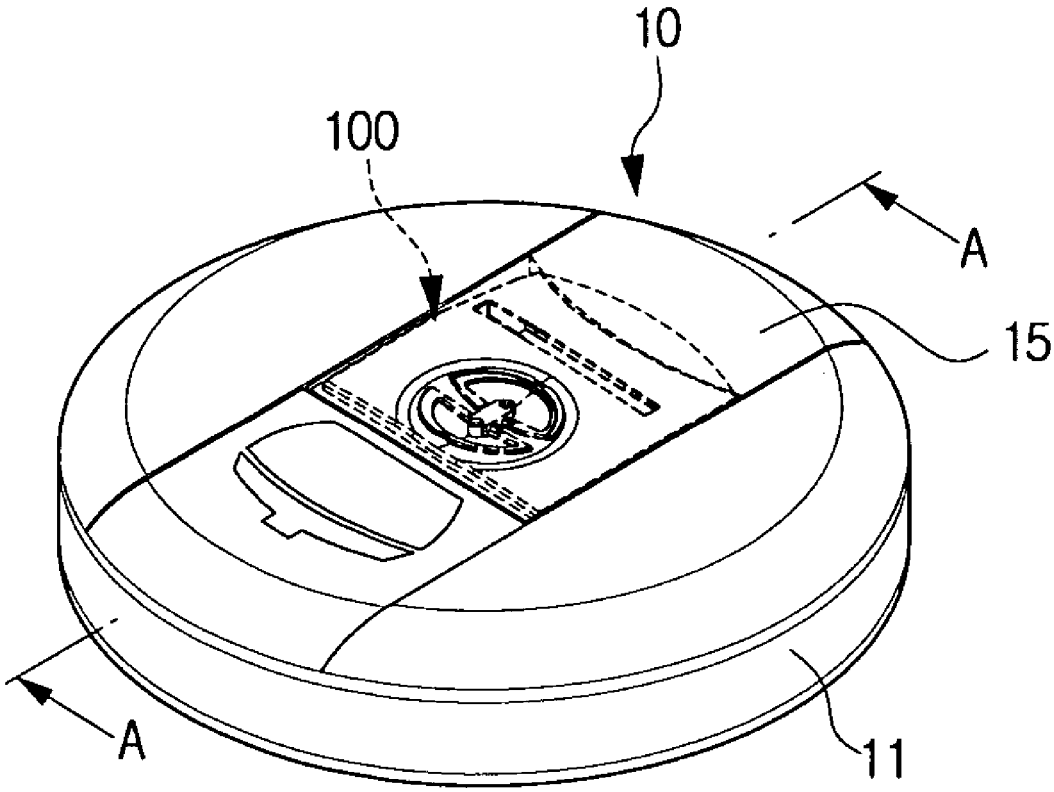
FIG. 1 is a perspective view of a robot cleaner according to an embodiment of the present invention.

Hereinafter, a robot cleaner according to an embodiment of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Also, description about general component parts of a robot cleaner, for example, a driving unit for automatic traveling, a sensor unit, and a control unit for conducting the driving unit and the sensor unit, will be omitted herein. Instead, the present invention will be described featuring a dust collection unit capable of realizing slim and compact size and guaranteeing a high suction force.

Figure 2:
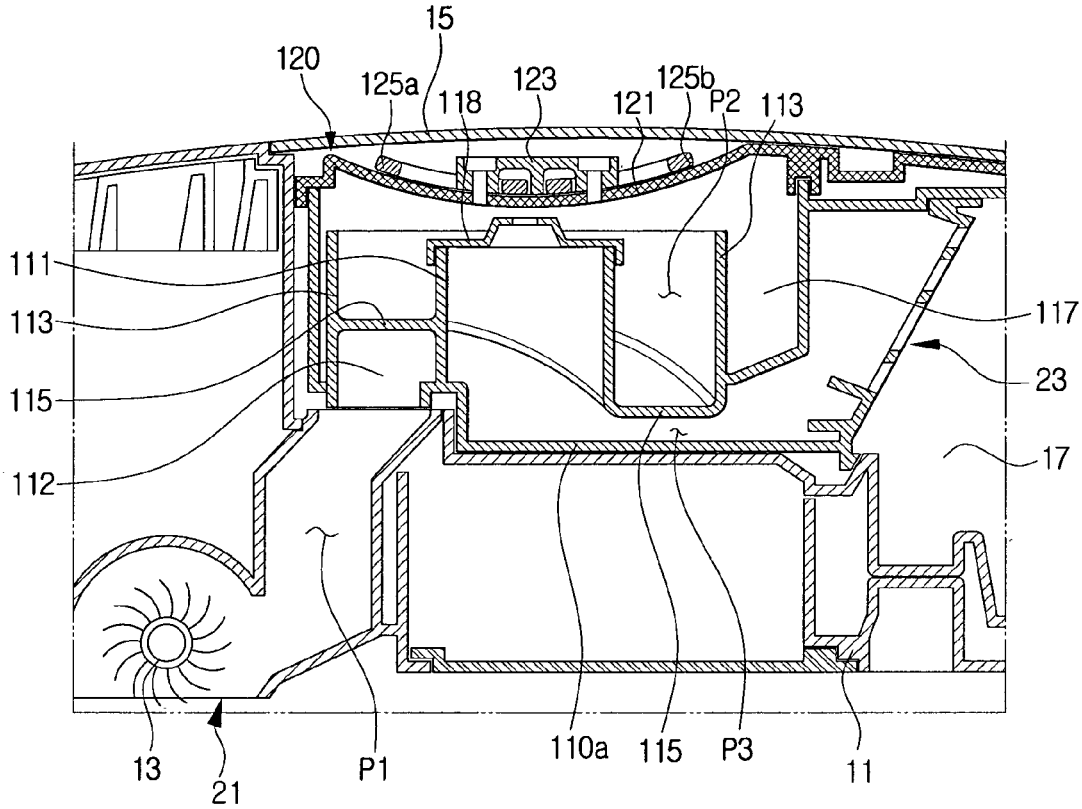
FIG. 2 is a side elevational view of the robot cleaner of FIG. 1 taken in section along line A-A.

As shown in FIG. 1, a robot cleaner 10 according to an embodiment of the present invention comprises a cleaner body 11 of a circular shape. However, body 11 can have any shape, such as a square, an oblong circle or the like. As shown in FIG. 2, a rotary brush 13 is disposed at the lower part of the body 11 inside a suction port 21. A dust collection unit 100 is removably mounted in the cleaner body 11 and covered by a main cover 15. The dust collection unit 100 will be described hereinafter with reference to FIGS. 3 through 5.

Figure 3:
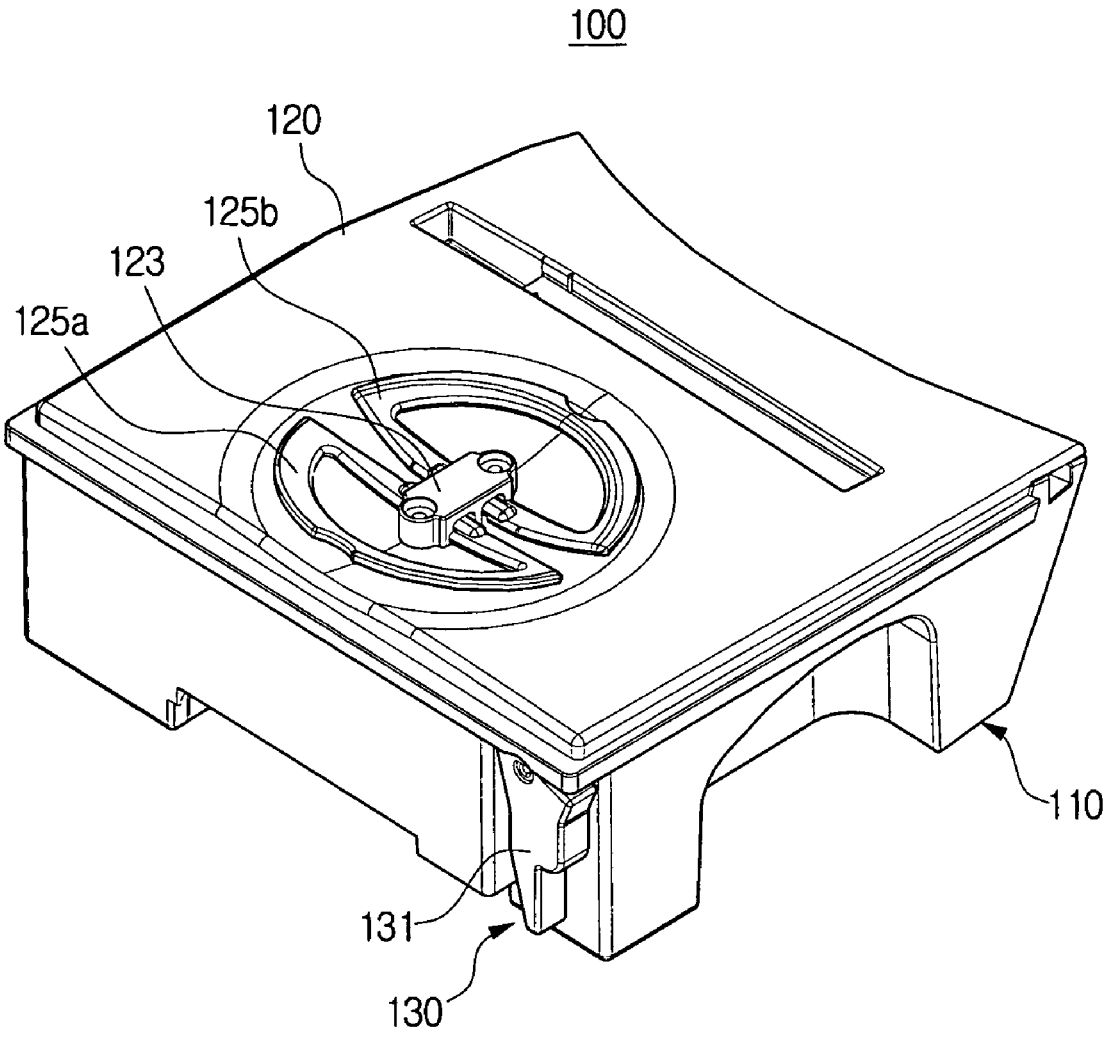
FIG. 3 is a perspective view of a dust collection unit of the robot cleaner of FIG. 1.
Figure 4:
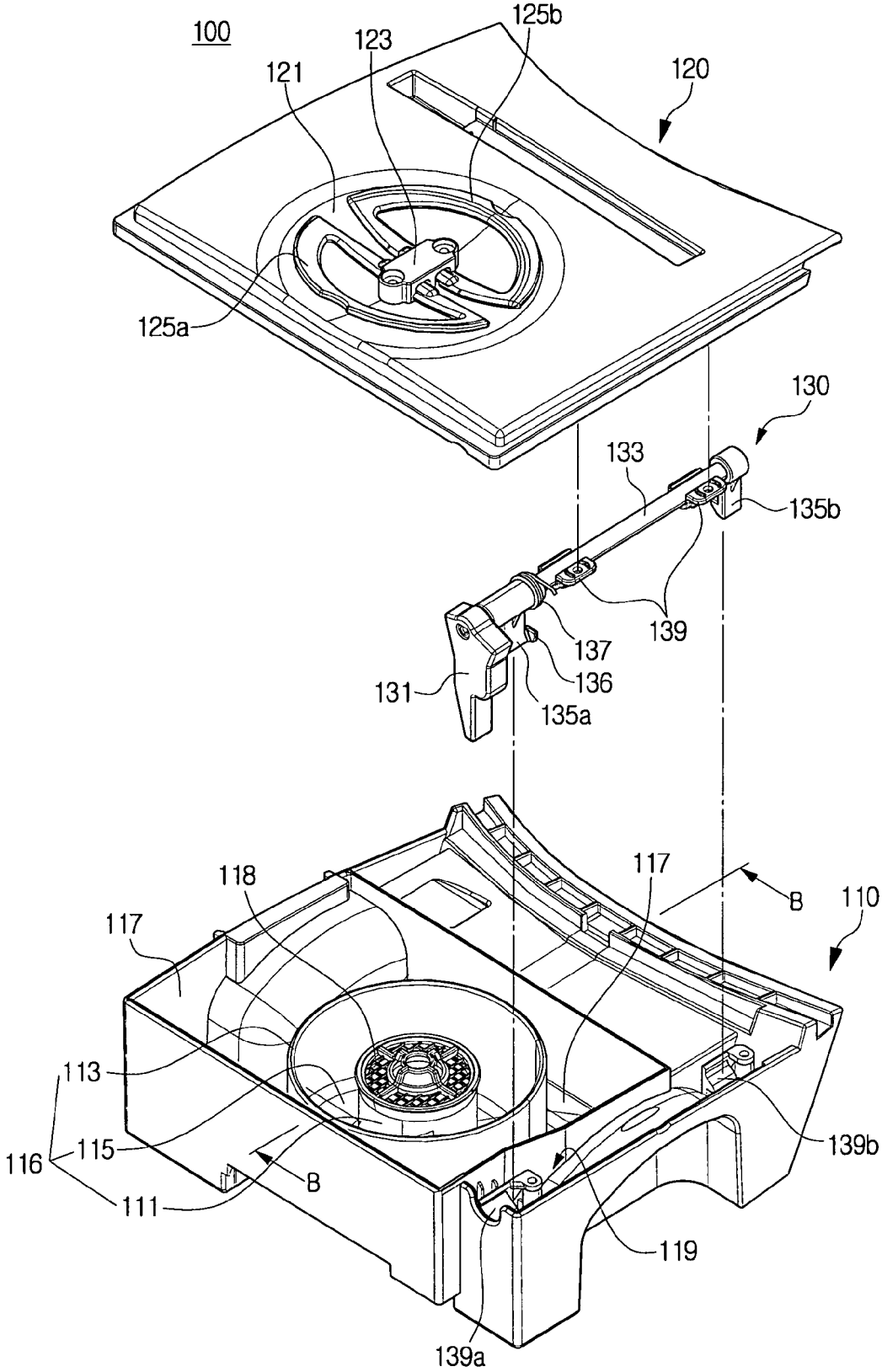
FIG. 4 is an exploded perspective view of the dust collection unit shown in FIG. 3.

As shown in FIGS. 3 and 4, the dust collection unit 100 comprises a dust collecting body 110, a cover 120 for covering the open upper part of the dust collecting body 110, and a locking unit 130 releasably locking the cover 120 to the dust collecting body 110.

The dust collecting body 110 includes a cyclone part 116 that accepts dust and air from a lower side thereof through the suction port 21 of the cleaner body 11 and through a suction path P1 (FIG. 2), and centrifugally separates dust from the air by generating a rotary air current. Further, the dust collecting body 110 may include a collection part 117 arranged to encompass the cyclone part 116 so as to collect the dust separated from the air. By arranging the cyclone part 116 and the collection part 117 breadthwise, the height of the robot cleaner can be reduced compared to conventional structures wherein the cyclone part 116 and the collection part 117 are vertically arranged.

In addition, the dust collecting body 110 comprises a discharge path P3 (FIG. 2) disposed at a lower part of the cyclone unit 116. The discharge path P3 guides to a discharge port 23 the air being discharged down through an inner canister 111 disposed in the center of the cyclone part 116. Referring to FIG. 4, the cyclone part 116 may include the inner canister 111 for discharging the dust-separated air through the discharge path P3, and an outer canister 113 enclosing the inner canister 111. The outer canister 113 becomes a boundary between the cyclone part 116 and the collection part 117. A grill filter 118 may be removably mounted to an upper end of the inner canister 111 to prevent the dust from flowing into the inner canister 111 through the grill filter 118.

As shown in FIG. 2, a bottom wall 115 may be connected between the inner and the outer canisters 111 and 113 forms a predetermined path P2 (FIG. 2) spirally extending upward. Because the spiral path P2 exerts a rotative force on the air drawn in through the suction path P1, the suction force is improved, particularly compared to the conventional cyclone structure, and simultaneously prevents deterioration of the initial suction force and maintains the initial suction force during use of the robot cleaner.

As shown in FIG. 2, in addition, since the bottom wall 115 isolates one side of the spiral path P2 from the discharge path P3, an entry portion 112 of the spiral path P2 that is in fluid communication with the suction path P1 can be disposed overlappingly with the discharge path P3 at a lower part of the cyclone part 116. Consequently, the height of the dust collection unit 100 can be minimized and also, the whole volume of the robot cleaner can be reduced. A bottom part 110*a* constituting the dust collecting body 110 continues to a lower end of the inner canister 111 and separates the entry portion 112 of the spiral path P2 from the discharge path P3.

According to the embodiment of the present invention by adopting the slim cyclone part 116, a suction force as high as the initial suction force can be maintained even if a small-size suction motor (not shown) is used, thereby improving cleaning performance.

The cover 120 may be removably connected to the upper part of the dust collecting body 110 to open and close the cyclone part 116 and the collection part 117. The cover 120 comprises a substantially hemispheric concave portion 121 recessed toward the inner canister 111. The concave portion 121 guides the dust separated from the air from the spiral path P2, to the collection part 117 disposed around the cyclone part 116. In addition, the concave portion 121 may form the upper end of the inner canister 111, where the air is drawn in, to narrow the open end so that air passing through the spiral path P2 is quickly drawn into the inner canister 111.

Figure 5:
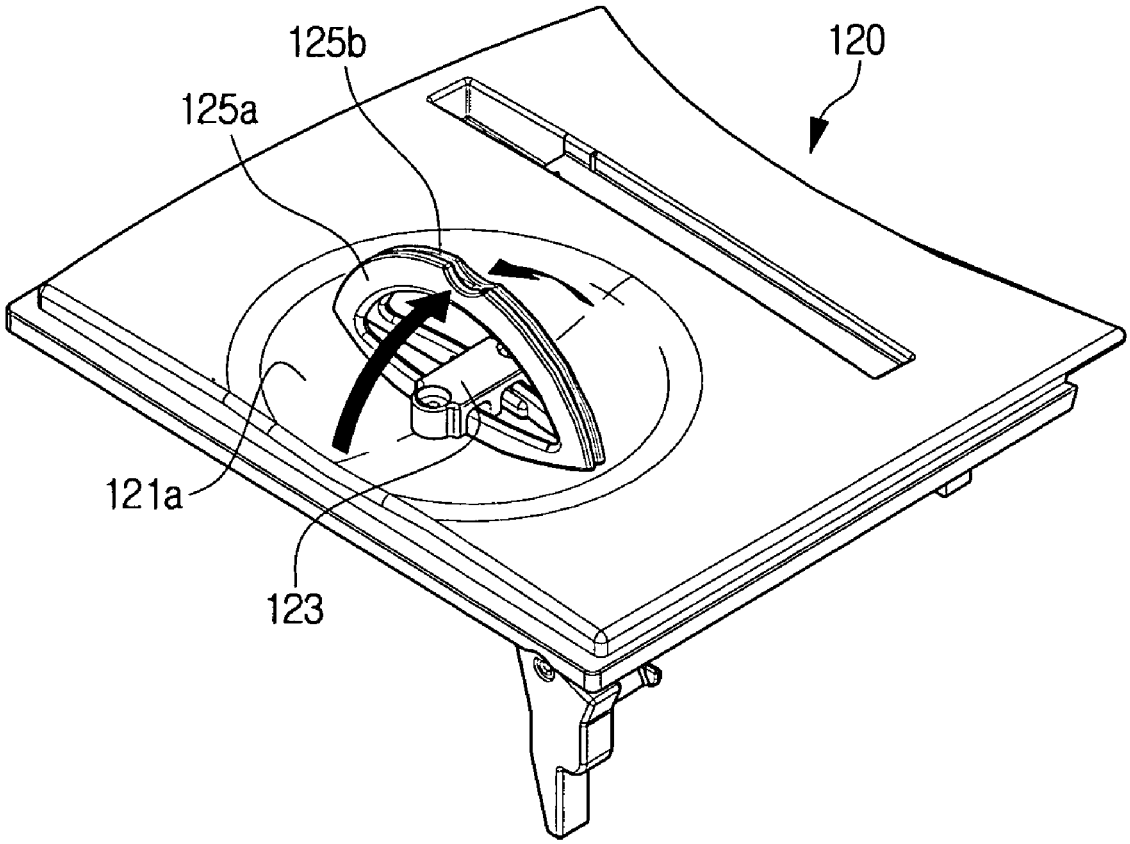
FIG. 5 is a perspective view showing a cover of the dust collection unit of FIG. 4.

As shown in FIG. 4, a pair of handles 125*a* and 125*b* for separating the dust collection unit 100 from the cleaner body 11 may be provided in the concave 121. Sides of the handles 125*a* and 125*b* are pivotably connected by a fixing projection 123 formed in the center of the concave portion 121. Before use, the handles 125*a* and 125*b* are received in the concave portion 121, as shown in FIG. 4. When using the handles 125*a* and 125*b*, the outer sides of the handles 125*a* and 125*b* are pivoted up to a vertical position so that the handles 125*a* and 125*b* face to each other, as shown in FIG. 5.

Preferably when the handles 125*a* and 125*b* are seated in the concave portion 121 with the fixing projection 123 they have height less than the depth of the concave portion 121. When the dust collection unit 100 is mounted in the cleaner body 11 and the main cover 15 (FIG. 1) is connected to the cleaner body 11, a bottom side of the main cover 15 comes into tight contact with a top side of the cover 120.

As shown in FIG. 4, a locking unit 130 comprises a pivot shaft 133 joined with one lower side of the cover 120. A lever 131 for pivoting the pivot shaft 133 is mounted to one side of the pivot shaft 133. First and second driving hooks 135*a* and 135*b* are disposed at opposite ends of the pivot shaft 133 at a predetermined interval from each other, and rotated in association with rotation of the pivot shaft 133 by the same degree as a rotating angle of the pivot shaft 133. Additionally, first and second fixing hooks 139*a* and 139*b* are disposed in a receiving part 119 formed at one side of the dust collecting body 110 of the dust collection unit 100, for snap-connection with the first and the second driving hooks 135*a* and 135*b*.

Figure 6A:
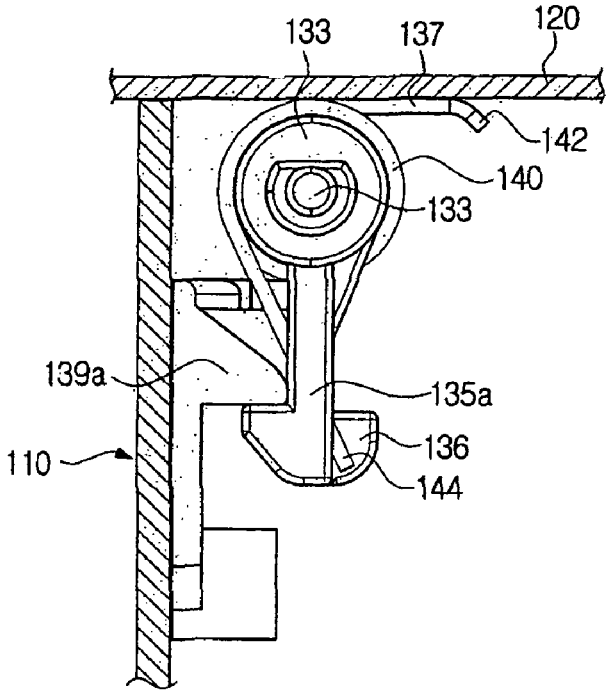
FIGS. 6A and 6B are partial sectional views illustrating locking and releasing states of the cover respectively, according to an operation of a locking unit of FIG. 4.

For resilient snap-connection of the first and the second driving hooks 135*a* and 135*b* with the first and the second fixing hooks 139*a* and 139*b*, respectively, the locking unit 130 may include a return spring 137 at one side of the pivot shaft 133. As shown in FIG. 6A, the return spring 137 is fixed to the pivot shaft 133 by a middle portion 140 thereof, supported by the lower surface of the cover 120 by one end 142 thereof, and fixed to a locking projection 136 formed on the first driving hook 135*a* by the other end 144 thereof.

Figure 6B:
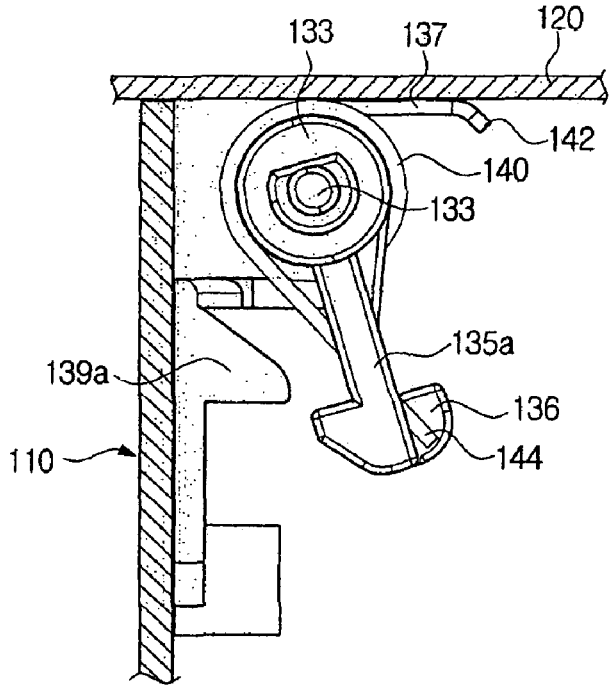

FIGS. 6A and 6B are partial sectional views showing locked and released states of the cover 120 according to the operation of the locking unit 130 of FIG. 4.

The operations of the locking unit 130 will be described with reference to FIGS. 6A and 6B as follows. Since locking and releasing operations of the first driving hook 135*a* and the first fixing hook 139*a* are performed in the same manner as the second driving hook 135*b* and the second fixing hook 139*b*, respectively, the operations of only the first driving and fixing hooks 135*a* and 139*a* will be explained.

Referring to FIG. 6A, in a locking state, the first driving hook 135*a* is snap-connected with the first fixing hook 139*a* by the resilience of the return spring 137. To release the locking unit 130 for removing the cover 120 from the dust collecting body 110, the lever 131 is pivoted by a predetermined angle away from the dust collecting body 110 until the first driving and fixing hooks 135*a* and 139*a* are released from each other.

Accordingly, the first driving hook 135*a* is pivoted together with the pivot shaft 133 in a direction going away from the dust collecting body 110. As a result, the snap-connection between the first driving hook 135*a* and the first fixing hook 139*a* is released, thereby releasing the locking unit 130. Then, the cover 120 can be separated from the cleaner body 110 simply by operating the lever 131.

The dust-suction operations of the robot cleaner 10 according to an embodiment of the present invention will now be described hereinafter.

Figure 7:
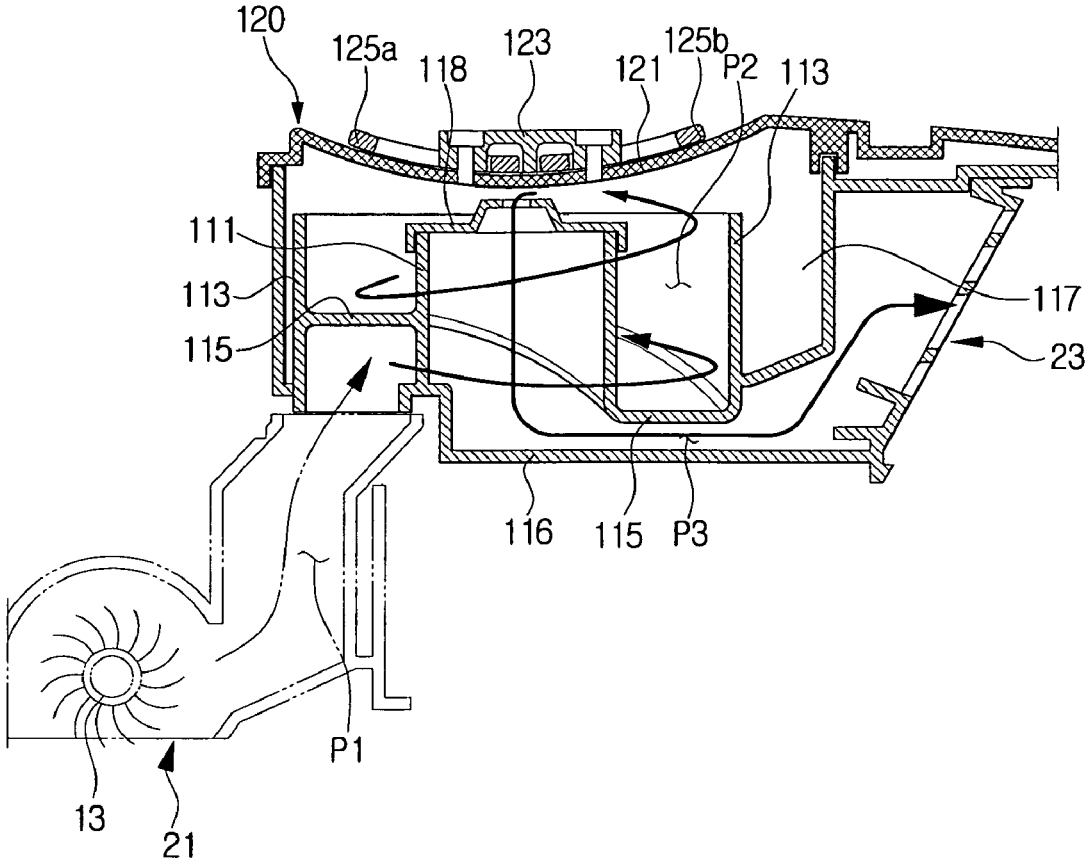
FIG. 7 is a side elevational view of the dust collection unit of FIG. 4 taken in section along line B-B.

Upon being powered, the robot cleaner 10 travels on the surface being cleaned along a predetermined route, drawing in dust and air through the suction port 21 via a suction motor (not shown), as shown in FIG. 7. The dust-laden air drawn in through the suction port 21 is guided to the lower part of the cyclone part 116 along the suction path P1 and then to the spiral path P2. The dust and air ascend along the spiral path P2, with its rotative force increasing more and more. after completely passing through the spiral path P2, the dust is separated from the air by a centrifugal force of the rotating air. The dust attaches to an inner wall of the outer canister 113 due to the centrifugal force and is then collected in the collection part 117.

The dust-separated air descends back along the inner canister 111, moves along the discharge path P3, and is drawn into a motor chamber 17 through the discharge port 23. The air drawn into the motor chamber 17 is passed through the suction motor (not shown) and discharged to the outside of the cleaner body 11.

According to the embodiment of the present invention as described above, the cyclone part 116, the inner canister 111, and the collection part 117 are arranged breadthwise, and part of the suction path P1 and the discharge path P3 are disposed overlappingly with the cyclone part 116. Therefore, the robot cleaner 10 can be implemented in a slim compact shape.

In addition, since the rotative force is exerted on the air being drawn into the cyclone part 116 through the spiral path P2 formed in the cyclone part 116, a high average suction force as well as a high initial suction force can be guaranteed.

Moreover, the at least one handle 125*a* and 125*b* pivotably mounted in the concave portion 121 of the cover 120 facilitates withdrawal of the dust collection unit 100 from the cleaner body 110 without changing the whole contour of the cyclone part 116 or deteriorating the dust separating performance of the cyclone part 116. Accordingly, the dust collection unit 100 can be conveniently mounted and separated with respect to the cleaner body 110, and maintenance of the robot cleaner 10 as well as the dust collection unit 100 is also facilitated. Furthermore, since the cover 120 is lockably connected to the dust collection unit 100, the dust separated is collected in the dust collection unit 100. Therefore, contamination of the environment is prevented, thereby enabling hygienic use of the cleaner.

While the invention has been shown and described with reference to certain embodiments thereof, it will be understood by those skilled in the art that various changes in form and details may be made therein without departing from the spirit and scope of the invention as defined by the appended claims.

What is claimed is:

1. A robot cleaner comprising:

a dust collection unit including, a cyclone part generating an ascending rotary air current from dust-laden air being drawn in through a lower part thereof, separating the dust from the air using a centrifugal force, and discharging the dust-separated air to the lower part through a center part thereof; a collection part surrounding the cyclone part and receiving the dust centrifugally separated from the air; and a cover removably connected to an upper part of the dust collection unit to open and close the cyclone part and the collection part, wherein the cover comprises:

a concave portion disposed on the cover at a position corresponding to the inner canister of the cyclone part and recessed toward the inner canister, to decrease volume of an upper end portion of the inner canister for favorable discharge of the air dust-separated by the cyclone part; and at lease one handle mounted in the concave portion to help withdrawal of the dust collection unit from the cleaner body.

2. The robot cleaner of claim 1, wherein the at least one handle is pivotably mounted to the concave portion by a fixing projection.

3. The robot cleaner of claim 1, further comprising a locking unit for releasably locking the cover to the dust collection unit.

4. The robot cleaner of claim 3, wherein the locking unit comprises:

a pivot shaft pivotably connected to one lower side of the cover;

a lever connected to one side of the pivot shaft to rotate the pivot shaft;

one or more driving hooks connected to ends of the pivot shaft and pivoting by an angle that is the same as the rotating angle of the pivot shaft;

one or more fixing hooks disposed at one side of the dust collection unit and snap-connected with the one or more driving hooks; and a return spring exerting resilience to the pivot shaft so as to resiliently bias the one or more driving hooks toward the corresponding fixing hooks.

5. A vacuum cleaner comprising:

a dust collection unit including, a cyclone part generating an ascending rotary air current from the dust-laden air being drawn in through a lower part thereof, separating the dust from the air using a centrifugal force, and discharging the dust-separated air to the lower part through a center part thereof, wherein the cyclone part comprises an inner canister for discharging therethrough the dust-separated air to a discharge path, an outer canister enclosing the inner canister and forming a boundary between the cyclone part and the collection part, and a bottom wall disposed at the inner and the outer canisters to form a spiral path, wherein the bottom wall isolates one side of a suction path and the discharge path from the spiral path, respectively; and a collection part surrounding the cyclone part to receive the dust centrifugally separated from the air, whereby the dust collection unit is overlapped at a lower part thereof with a discharge path for guiding the air dust-separated by the dust collection unit to a discharge port, wherein the dust collection unit further comprises a cover removably connected to an upper part thereof to open and close the cyclone part and the collection part, and the cover comprises:

a concave portion disposed on the cover at a position corresponding to the inner canister of the cyclone part and recessed toward the inner canister, to decrease volume of an upper end portion of the inner canister for favorable discharge of the air dust-separated by the cyclone part; and one or more handles mounted in the concave portion to help withdrawal of the dust collection unit from the cleaner body.

6. A vacuum cleaner comprising:

a dust collection unit including, a cyclone part generating an ascending rotary air current from the dust-laden air being drawn in through a lower part thereof, separating the dust from the air using a centrifugal force, and discharging the dust-separated air to the lower part through a center part thereof, wherein the cyclone part comprises an inner canister for discharging therethrough the dust-separated air to a discharge path, an outer canister enclosing the inner canister and forming a boundary between the cyclone part and the collection part, and a bottom wall disposed at the inner and the outer canisters to form a spiral path, wherein the bottom wall isolates one side of a suction path and the discharge path from the spiral path, respectively, a collection part surrounding the cyclone part to receive the dust centrifugally separated from the air, whereby the dust collection unit is overlapped at a lower part thereof with a discharge path for guiding the air dust-separated by the dust collection unit to a discharge port; and a locking unit for resealably locking the cover to the dust collection unit, and wherein the locking unit comprises:

a pivot shaft pivotably connected to one lower side of the cover;

a lever connected to one side of the pivot shaft to rotate the pivot shaft;

one or more driving hooks connected by one ends thereof to a circumference of the pivot shaft and pivoting by an angle the same as a rotating angle of the pivot shaft;

one or more fixing hooks dispose at one side of the dust collection unit and snap-connected with the one or more driving hooks; and a return spring exerting resilience to the pivot shaft so as to resiliently bias the one or more driving hooks toward the corresponding fixing hooks.

* * * * *